US005630294A

United States Patent [19]

Bruno

[11] Patent Number: 5,630,294

[45] Date of Patent: May 20, 1997

[54] ARRANGEMENT OF SLIDING DOOR FOR CARGO VEHICLES

[75] Inventor: Eduardo Vicente Bruno, Alsina 474, (1642) San Isidro, Buenos Aires, Argentina

[73] Assignees: Eduardo Vicente Bruno; Jorge Ricardo Lepretre, both of Buenos Aires, Argentina

[21] Appl. No.: 205,490

[22] Filed: Mar. 4, 1994

[30] Foreign Application Priority Data

Mar. 5, 1993 [AR] Argentina ..... 324431

[51] Int. Cl.[6] ..... E05D 15/10

[52] U.S. Cl. ..... 49/209; 49/410

[58] Field of Search ..... 49/208, 209, 409, 49/410, 411

[56] References Cited

U.S. PATENT DOCUMENTS

| | | | |
|---|---|---|---|
| 2,672,656 | 3/1954 | Corenz | 49/209 |
| 2,842,810 | 7/1958 | Gangl | 49/209 X |
| 3,334,442 | 8/1967 | Boettcher | 49/410 X |
| 3,611,637 | 10/1971 | Saino | 49/410 X |
| 4,114,317 | 9/1978 | Crawley | 49/209 |
| 4,575,966 | 3/1986 | Gerritsen | 49/209 |
| 4,624,074 | 11/1986 | Shuttleworth | 49/130 X |
| 4,716,693 | 1/1988 | Webster | 49/410 X |
| 5,076,018 | 12/1991 | Gianfranco | 49/410 |
| 5,280,686 | 1/1994 | Davies | 49/209 |
| 5,301,468 | 4/1994 | Kamezaki | 49/209 X |

*Primary Examiner*—Kenneth J. Dorner
*Assistant Examiner*—Jerry Redman
*Attorney, Agent, or Firm*—Lowe, Price, LeBlanc & Becker

[57] ABSTRACT

A vehicle door arrangement suitable for a cargo transport vehicle provides for at least one door to be slidably guided by a single rail provided in the vehicle side near the top of the door. Guidance to the door between a closing position and an open position is provided by an arm located at the top of the door and carrying a wheel and a guide lug which are respectively supported and guided by the rail. A mechanism including a levered shaft is provided at the side of the vehicle near the bottom of the door and is operable to engage with the door therat to hold it in a closed position relative to the vehicle.

8 Claims, 1 Drawing Sheet

ARRANGEMENT OF SLIDING DOOR FOR CARGO VEHICLES

FIELD OF THE INVENTION

This invention relates to an arrangement of lateral sliding doors for cargo vehicles, such as trucks or trailers. This invention is particularly suitable for being used in trucks that transport crates, for example crates containing beverages, that are loaded and unloaded laterally.

BACKGROUND OF THE RELEVANT ART

Trucks that have shuttered partitions as lateral closures are known and are used currently. Although they are in wide use, these partitions entail a series of disadvantages. They are noisy and they have a large number of mobile pieces that are difficult to repair. This implies expensive maintenance and high replacement cost. They also have side rails that are very vulnerable to impacts by forklifts; as a result, the partitions are jammed or they have to be forced so that they will run along the rails.

It is the objective of this invention to solve the above-mention problems and to provide an easily operated side door with low maintenance cost.

SUMMARY OF THE INVENTION

The principal object of this invention is to provide an arrangement of sliding side doors for cargo vehicles, such as trucks and trailers, comprising at least one door, which along its upper edge has at least two means allowing the door to be guided and to slide along a single rail, the rail being attached to the upper part of the vehicle, the vehicle having means for closing the door against the vehicle.

The single rail is used by all doors arranged on one and the same vehicle side since the door, when in the closed position, rests against the posterior part of the rail, leaving a free space for the movement of a second door in front of it.

BRIEF DESCRIPTION OF THE DRAWING

The invention will be better understood with respect to the attached drawings, where.

DETAILED DESCRIPTION OF THE PREFERRED EMBODIMENTS

Figure 1:
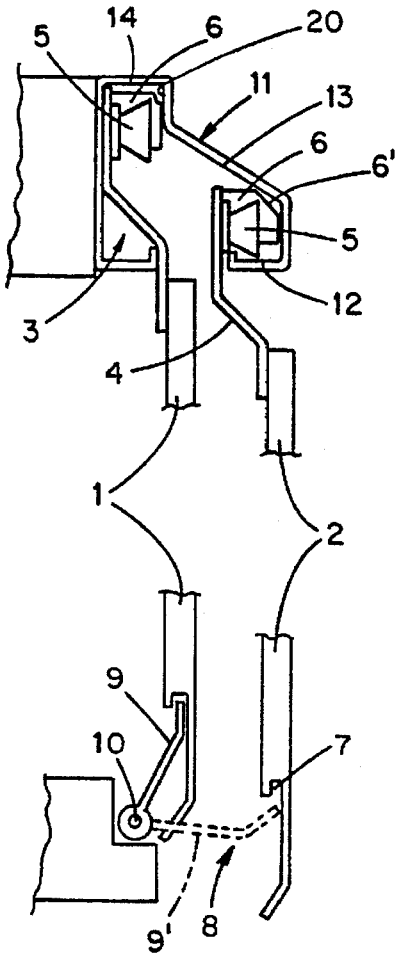
FIG. 1 schematically and partially illustrates the arrangement according to a preferred embodiment of the invention.
Figure 2:
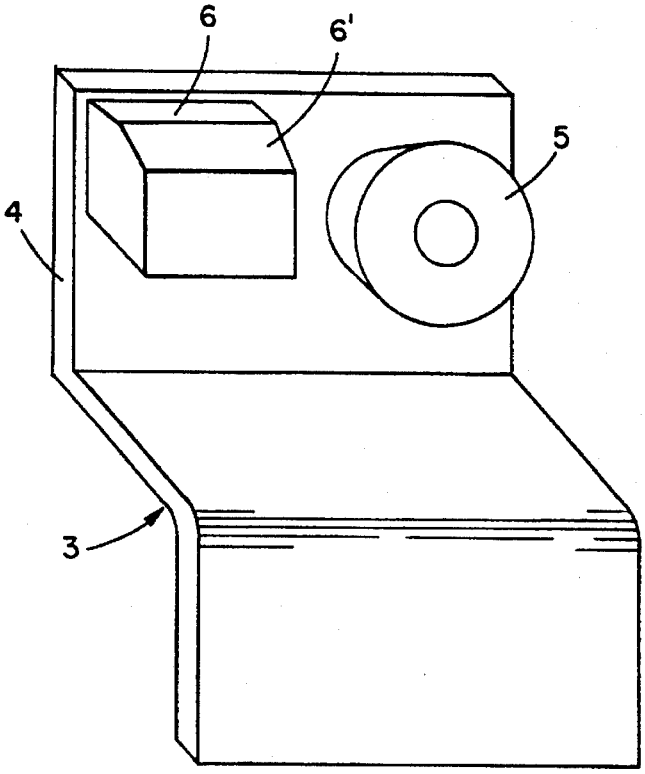
FIG. 2 shows means for allowing the door to be guided and to slide relative to the vehicle body.
Figure 3:
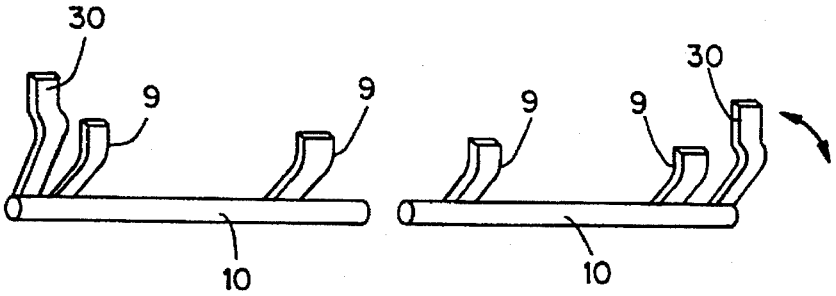

FIG. 1 shows a door 1 in its closed position and a door 2 in its sliding position. On their upper edges, doors 1 and 2 both have at least one means for guidance and sliding 3, consisting of a rigid plate 4, suitably bent and attached to the door, for example by means of welding at one of its ends, and being provided at its other end with a wheel 5 and a guide lug 6, as best seen in FIG. 2.

On their lower edges, doors 1 and 2 each have a groove 7 for the introduction of closing means 8, consisting of at least one arm 9, preferably two, each in the shape of an L and mounted on a shaft 10 arranged along the vehicle side. The arms 9 are integral with shaft 10 which at one of its ends is secured to a closing lever (not shown).

When in operation, door 2 is suspended from a rail 11 that has a groove 12, along which moves wheel 5, a sliding surface 13 for guiding guide lugs 6, and an upper portion 14 for accommodating guide lug 6 in the closed door position.

Door 2 moves along rail 11 by means of wheel 5 which runs along groove 12. Once door 2 is located in the position in which it will be closed, the closing lever will be operated manually and this will cause shaft 10 and arms 9 to turn. The arms 9 engage door 2 via its groove 7, and are operable to raise door 2.

As best seen in FIG. 1, when the door is in its open position the arm 9 is rotated to a position indicated by broken lines and numbered 9'. When the door is raised to its closed position, guide lug 6, which has an inclined edge 6' makes sliding contact with the sliding surface 13 of rail 11. This causes guide and movement means 3 to slide toward an upper closing position in which the door remains firmly closed, since its upper part continues to be held by guide lug 6 that remains secured at the upper end 14 of the rail, and the lower part remains secured by arms 9 which are fastened in the closing position by means of the closing lever. The closing lever 30 is secured to the vehicle body, for example by means of a latch. When door 1 is in its closing position, sliding surface 13 of rail 11 preferably presents an upward portion 20 which cooperates with guide lugs 6 to keep them in their corresponding position.

Wheel 5 preferably has a generally conical shape and is preferably metallic. Guide lug 6 is preferably made of Teflon™.

The arrangement of the side doors, according to this invention, not only makes it possible to eliminate the previously-mentioned disadvantages, but it also allows use of larger doors. This requires the vehicle to have fewer posts and less width with equal cargo capacity. Since such an arrangement has only two mobile parts per door, the door is easier to operate, easier to repair, and easier to maintain. The only requirement is periodically to lubricate the rollers of wheels 5 and rail 11.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. An arrangement of sliding side doors, for closing an opening in a side of a cargo transport vehicle, comprising:

a single rail provided along the side of the vehicle;

at least one door;

support means provided at an upper edge of said at least one door, said support means enabling said at least one door to be supported on and be guided by said single rail to slide relative to the side of the vehicle and relative to each other, said support means comprising a rotatable wheel and a fixed guide lug both non-pivotably mounted to the corresponding door and located during use inside said single rail; and closing means supported at a lower portion of said side of the vehicle to engage a lower portion of each door in a respective closed position thereof.

2. The arrangement of doors according to claim 1, wherein:

said closing means comprises a shaft that is provided with at least two L-shaped arms, and a closing lever, wherein said arms and said lever are integral with said shaft.

3. An arrangement of sliding side doors, for closing an opening in a side of a cargo transport vehicle, comprising:

a single rail provided along the side of the vehicle;

at least one door;

support means provided at an upper edge of said at least one door, said support means enabling said at least one door to be supported on and guided by said single rail to slide relative to the vehicle, said support means comprising a rotatable wheel and a fixed guide lug both non-pivotably mounted to the at least one door and located during use inside said single rail; and closing means arranged at a lower portion of said side of the vehicle to engage a lower portion of said at least one door in a closed position thereof, wherein said wheel is a conical wheel and said guide lug has an inclined edge for making sliding contact with an inside surface of said single rail.

4. An arrangement of sliding side doors, for closing an opening in a side of a cargo transport vehicle, comprising:

a single rail provided along the side of the vehicle;

at least one door;

support means provided at an upper edge of said at least one door, said support means enabling said at least one door to be supported on and guided by said single rail to slide relative to the vehicle, said support means comprising a rotatable wheel and a fixed guide lug both non-pivotably mounted to the at least one door and located during use inside said single rail; and closing means arranged at a lower portion of said side of the vehicle to engage a lower portion of said at least one door in a closed position thereof, wherein said wheel is metallic and said guide lug is made of material suitable for making low-friction sliding contact with an inside surface of said single rail.

5. The arrangement according to claim 3, wherein: the material of the guide lug is polytetrafluoroethylene.

6. An arrangement of a plurality of sliding side doors, closing an opening in a side of a cargo transport vehicle, comprising:

a single rail provided along the side of the vehicle;

at least one door;

support means provided at an upper edge of said at least one door, said support means enabling said at least one door to be supported on and guided by said single rail to slide relative to the vehicle, said support means comprising a wheel and a guide lug fixed to said at least one door and located during use inside said single rail; and closing means arranged at a lower side of the vehicle to engage a lower portion of said at least one door in a closed position thereof, wherein said single rail has a sliding groove for receiving said wheel therein, a sliding surface for guiding said guide lug by making sliding contact therewith, and an upper end portion for receiving said guide lug within the rail.

7. The arrangement of doors according to claim 6, wherein:

said sliding surface of said single rail comprises an upward, inclined, inside surface portion for guiding and accommodating said guide lug and extending to a location corresponding to a closed position of said at least one door.

8. An arrangement of a plurality of sliding side doors, for closing an opening in a side of a cargo transport vehicle, comprising:

a single rail provided along the side of the vehicle;

at least one door;

support means provided at an upper edge of said at least one door, said support means enabling said at least one door to be supported on and guided by said single rail to slide relative to the vehicle, said support means comprising a rotatable wheel and a fixed guide lug both mounted to the door and located during use inside said single rail provided along said side of the vehicle; and closing means mounted to a lower portion of said side of the vehicle to engage a lower portion of said at least one door in a closed position thereof, wherein said closing means comprises a shaft that is provided with at least two L-shaped arms, and a closing lever, wherein said arms and said lever are integral with said shaft, and said at least one door is provided with a U-shaped groove along a lower edge for receiving said arms.

* * * * *